US005407063A

United States Patent [19]

Warner et al.

[11] Patent Number: 5,407,063

[45] Date of Patent: Apr. 18, 1995

[54] SOCKET TRAY WITH ADJUSTABLE SOCKET GUIDES

[75] Inventors: Donald R. Warner, Columbia Cross Roads, Pa.; David R. Melrose, Ringoes, N.J.

[73] Assignee: Ingersoll-Rand Company, Woodcliff Lake, N.J.

[21] Appl. No.: 277,141

[22] Filed: Jul. 5, 1994

[51] Int. Cl.[6] ..... B65D 85/20

[52] U.S. Cl. ..... 206/45.15; 206/378; 206/565

[58] Field of Search ..... 340/568, 687; 206/372, 206/373, 376, 377, 378, 557, 45.15, 559, 560, 565

[56] References Cited

U.S. PATENT DOCUMENTS

| | | | |
|---|---|---|---|
| 4,711,353 | 12/1987 | Rozmestor | 206/378 |
| 4,791,411 | 12/1988 | Staar | 340/568 |
| 5,083,664 | 1/1992 | Feng | 206/378 X |
| 5,328,029 | 7/1994 | Chow | 206/378 |

*Primary Examiner*—Jacob K. Ackun
*Attorney, Agent, or Firm*—Walter C. Vliet

[57] ABSTRACT

An adjustable socket tray for visually displaying a socket for selection of the socket size and/or a fastener tightening strategy wherein the socket is restrained by a movable "V" block to retain the socket about a centerline incident with a sensor to determine the selection of the socket.

3 Claims, 1 Drawing Sheet

SOCKET TRAY WITH ADJUSTABLE SOCKET GUIDES

BACKGROUND OF THE INVENTION

This invention relates generally to selected assistance storage devices and more particularly to a storage tray for fastener driving sockets and the like wherein the act of socket selection coordinates the selection with an appropriate driving force of a driving tool. With the advent of computer controlled air and electric nutrunner tools in vehicle assembly and similar industries, there is an increasing need for different size fastener sockets to be handy to the operator or assembler.

This may be accomplished with the use of electric socket trays. These socket trays are equipped with switches (electromechanical, optical or magnetic proximity type) that signal the computer to change fastening strategy (torque/angle or other) as the particular socket is removed from the tray and attached to the nutrunner. As the socket is removed from the tray, the switch near or under the socket is actuated thereby sending a signal to the computer to change the strategy.

Current socket trays lack adjustability or are difficult to adjust and are manufactured for specific socket sizes and quantity. There is a need for socket trays that adjust to accept different size sockets as well as allowing assembly of both four or eight or more position trays using common parts.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention this is accomplished by providing an adjustable socket tray comprising a tray for visually displaying and supporting two or more sockets; a plurality of movable restraints movable along a centerline for adjustably supporting the sockets about a centerline on the tray; means for detecting the presence of a socket in the tray; and means for determining a condition response in response to the detected presence of the socket; and, the plurality of movable restraints further comprise a restraint movable along the centerline to adjustably locate and restrain a socket on the tray and in contact with the means for detecting the presence of the socket.

The foregoing and other aspects will become apparent from the following detailed description of the invention when considered in conjunction with the accompanying drawing figures.

DETAILED DESCRIPTION

Figure 1:
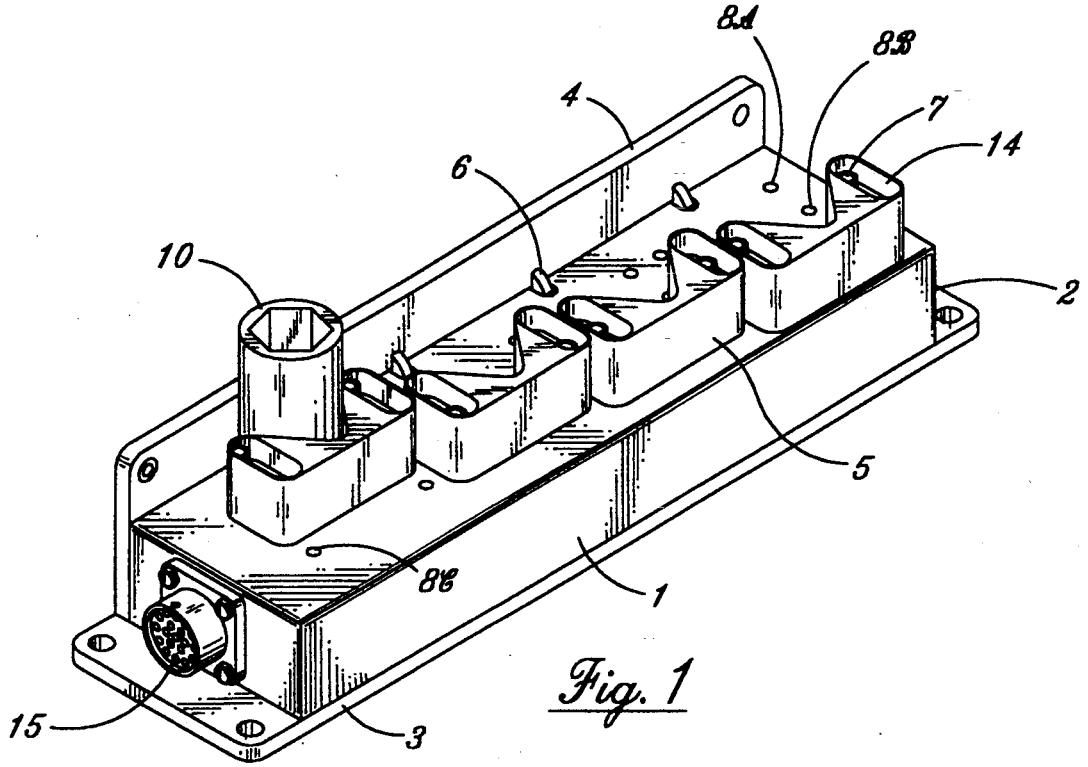
FIG. 1 is an isometric view of a socket tray according to the present invention.

Referring to FIG. 1, an adjustable socket tray according to the present invention is shown and generally designated by the reference numeral 1. The tray 1 is formed from a hollow box-like base 2 provided with a bottom mounting flange 3 and a rear mounting flange which further serves as a socket rest 4. Mounted on top of the base 2 are four socket guides or "V" blocks 5. The blocks 5 are adjustably retained by means of position screws 7 which in turn engage a plurality of spaced threaded position screw holes 8*a*, 8*b* and 8*c* (six provided for each block in the embodiment shown). A sensor switch 6 is provided on the centerline of each "V" block near the rear mounting flange and socket rest 4. The sensor switches 6 are electrically connected to a receptacle 15 in the side of the base 2. The receptacle 15 is further connected to a signal cable (not shown), which communicates the presence of the sockets to a suitable computer device (not shown) or the like used to establish the fastener logic associated with the socket selection.

A socket 10 is shown disposed in the extreme left position between the rear mounting flange 4 and the socket guide 5. The position screws 7 cooperate within a slot 14 in each side of the socket guide 5 to permit limited travel adjustment of the socket guide 5 back and forth along a centerline 11 (shown in FIG. 2). The centerline intersects the sensor switch 6 and the bottom of the "V" block 5. The socket guide or "V" block 5 securely holds and positions the socket 10 as shown in FIG. 1 and permits adjustability and acceptance of a great range of socket diameters. The series of threaded position screw holes 8*a*, 8*b*, and 8*c* are provided in increasing distance from the rear mounting flange to provide a greater range of socket diameter for a given "V" block width. The support guides or "V" blocks 5 are of sufficient height to securely engage a substantial length of the socket 10 thereby permitting the trays to be positioned anywhere from a horizontal position (shown) to a near vertical position, if desired.

Figure 2:
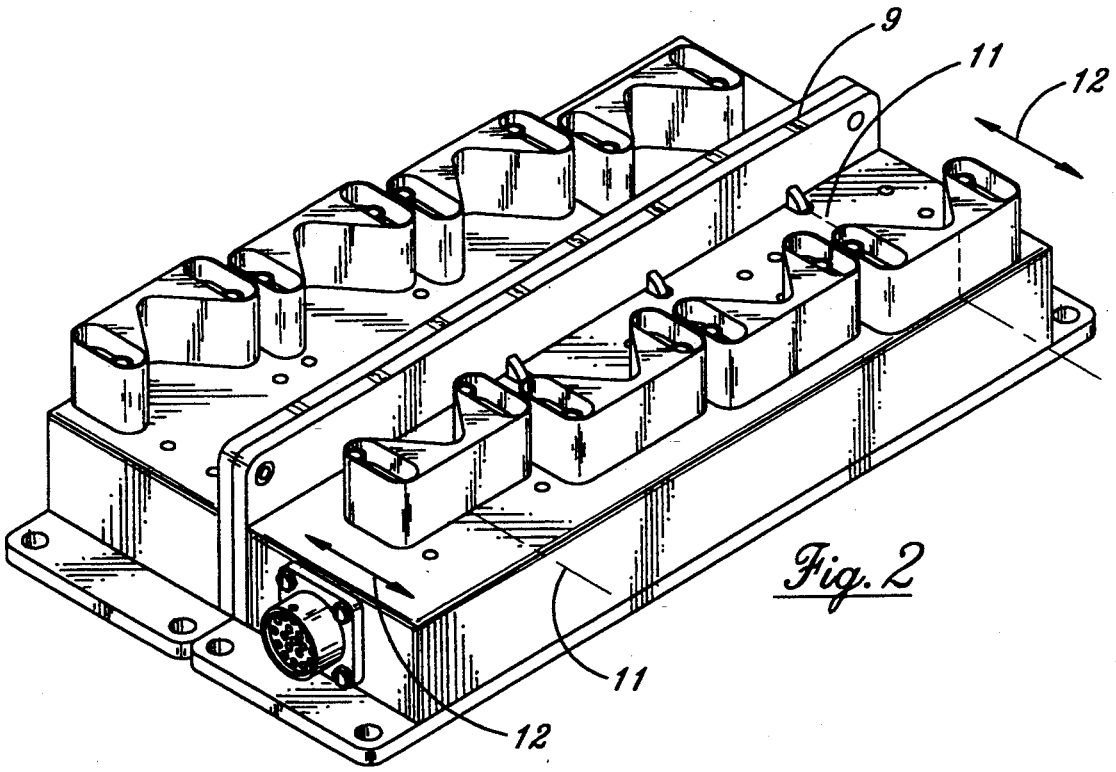
FIG. 2 is an isometric view of a combination of two trays to expand the number of sockets addressed according to the present invention.

The device as shown permits ready adjustability for varying socket sizes by simply backing off the positioning screw positioning the "V" block and with the socket compressed between the "V" block and the rear mounting flange 4, retightening the screws. If the range of socket sizes require acceptance of a larger diameter socket than permitted by the slot travel, the position screw may be repositioned in any one of the three threaded position screw holes provided for each side of the socket guide 5. This provides a wide range of adjustment and easy fine adjustment of the socket guide along the centerline 11 in the direction of the double arrow 12 as shown in FIG. 2.

Another feature of the present design is the fact that the socket guides are displaced one-half space from one end of the base 2. As shown in FIG. 2 this permits the back to back stacking of the socket tray while providing a one-half space alternate display of the sockets which permit ready selection. As shown in FIG. 2 each position may be numbered (see reference numeral 9) for ready selection of an appropriate socket in an assembly procedure.

What is claimed is:

1. An adjustable socket tray, comprising:

a tray for visually displaying and supporting two or more sockets;

a plurality of movable restraints movable along a centerline for adjustably supporting said sockets about said centerline on said tray;

means for detecting the presence of said sockets in said tray;

means for determining a condition response in response to the detected presence of said socket; and said plurality of movable restraints further comprise a restraint movable along said centerline to adjustably locate and restrain said socket on said tray and in contact with said means for detecting the presence of said socket.

2. An adjustable socket tray according to claim 1 wherein: said movable restraint comprises a movable "V" block.

3. An adjustable socket tray according to claim 1 wherein: said movable restraint is offset one-half spacing from one end of said tray as a means for offsetting sockets retained in the tray when the trays are mounted back to back.

* * * * *